United States Patent [19]

Croopnick et al.

[11] Patent Number: 4,675,859

[45] Date of Patent: Jun. 23, 1987

[54] INTENSIFIED FIELD FOCUS MOVING COIL PHONOCARTRIDGE ASSEMBLY

[75] Inventors: Bruce J. Croopnick, Berkeley; David W. Fletcher, Oakland, both of Calif.

[73] Assignee: Sumiko, Inc., Berkeley, Calif.

[21] Appl. No.: 708,180

[22] Filed: Mar. 5, 1985

[51] Int. Cl.[4] ..... H04R 9/16

[52] U.S. Cl. ..... 369/147; 369/139; 369/146

[58] Field of Search ..... 369/146–147, 369/135, 136, 139, 170

[56] References Cited

U.S. PATENT DOCUMENTS

| | | | |
|---|---|---|---|
| 3,618,124 | 11/1971 | Dreisback | 369/147 X |
| 3,956,598 | 5/1976 | Kawakami et al. | 369/147 X |
| 3,963,880 | 6/1976 | Ikeda | 369/147 X |
| 4,103,117 | 7/1978 | Morinaga | 369/146 |
| 4,160,268 | 7/1979 | Goto et al. | 369/147 X |
| 4,237,349 | 12/1980 | Hansen et al. | 369/147 |
| 4,249,747 | 2/1981 | Bauer et al. | 369/146 X |
| 4,382,454 | 5/1983 | Aoki et al. | 369/170 X |
| 4,397,013 | 8/1983 | Shiomi et al. | 369/170 |
| 4,488,284 | 12/1984 | Aoki et al. | 369/147 |
| 4,541,877 | 9/1985 | Stadelmaier et al. | 148/101 |

FOREIGN PATENT DOCUMENTS

| | | | |
|---|---|---|---|
| 55-102998 | 8/1980 | Japan | 369/147 |

*Primary Examiner*—Raymond F. Cardillo
*Assistant Examiner*—Wayne R. Young
*Attorney, Agent, or Firm*—Michael J. Hughes

[57] ABSTRACT

The invention is an intensified field focus moving coil phonocartridge assembly (10) including a rear magnet (32) and a front magnet (34) mounted in an axially juxtaposed manner within a support sleeve (38) so as to define therewith a magnetic field chamber (36). A signal coil subassembly (26) is suspended within the field chamber (36) and affixed to a cantilever (24) having a stylus (22) on its opposite end such that vibrations of the stylus (22) are physically translated to the signal coil subassembly (26). Electrical signals generated by the currents induced in the windings (29 and 30) of the signal coil subassembly (26) by induction caused by vibration within the field chamber (36) are carried to signal output pins (18) for electronic processing. The primary usage for the phonocartridge assembly (10) is in high quality stereo phonographic equipment for playing phonograph records.

7 Claims, 3 Drawing Figures

INTENSIFIED FIELD FOCUS MOVING COIL PHONOCARTRIDGE ASSEMBLY

TECHNICAL FIELD

The present invention relates generally to sound reproduction equipment and more particularly to phonocartridges utilized for translating physical perturbations in record grooves to electrical signals for translation to sound waves.

BACKGROUND ART

Ever since Thomas Edison invented the phonograph in the 19th Century, audiophiles have made continuing efforts to improve the quality of mass reproduction of sound. Some of these attempts have gone off in widely varying directions, such as those represented by magnetic tape and digital optical disks. However, by far the most popular method of mass reproduction of music and other sound phenomena is by the use of vinyl disks known as "records". These records are recorded with physical perturbations within a spiral groove which correspond to the sounds recorded. The completed record, be it an album or single, is then placed on a phonograph connected to electrical or electronic signal translating equipment which then, to a greater or lesser degree, reproduces the original sounds.

The phonograph has several key elements. One of these is the pickup element which actually engages the record disk and receives the vibrations from the perturbations within the grooves. The pickup element is ordinarily carried on a tone-arm of any of several designs while the record disk itself is caused to rotate with respect to the pick-up element by a turntable or a similar element. The present invention deals with the pickup element portion of the phonograph which translates the perturbations into electrical signals.

On an older or less sophisticated phonograph record playing apparatus, the pickup element may be a simple needle or rigidly mounted stylus, without any particular integrated vibrational translation apparatus. However, modern equipment, at least on the higher quality levels, utilizes elements known as "phonocartridges" which include a stylus, which actually engages the record groove, and various other elements which translate the vibrations in the stylus to electrical signals which are then delivered along the tone arm wiring to the electrical equipment which translates the signals back into sound waves which theoretically match those originally recorded. Phonocartridges have advanced from mere preamplifiers of the signals to highly sophisticated vibrational translating elements as technology has improved.

One type of phonocartridge which has achieved great popularity is that known as a moving coil phonocartridge. A prime example of a previously known method of achieving moving coil signals based on a stylus and cantilever is shown in FIGS. 1 and 2 of U.S. Pat. No. 3,679,843, issued to Cho on Jan. 4, 1971. The operational characteristics of the prior art cartridges utilize a magnet and a series of non-permanently magnetic, but magnetically conducting, yokes to shape the field about windings which are carried within the magnetic field and are caused to vibrate therein by the tracking of a stylus on a record groove. This type of audio pickup mechanism, and various improvements thereon, have become a standard type of phonocartirdge within the industry.

Some of the improved versions of the basic moving coil type phonographic pickup cartridge are, in addition to Cho, U.S. Pat. No. 3,956,598, issued to Kawakami, et al on May 11, 1976; U.S. Pat. No. 3,299,219 issued to Madsen on Jan. 17, 1967 and U.S. Pat. No. 3,963,880 issued to Ikeda on June 15, 1976. Some precursors of this technology are found in U.S. Pat. No. 3,236,955, issued to Klemp, at al on Feb. 22, 1966 and U.S. Pat. No. 3,040,136, issued to Grado on June 19, 1962.

Numerous commercially available phonocartridges also use the prior art technology. One such series of cartridges, known as the Talisman family, manufactured by Sumiko, Inc. of Berkeley, Calif., exemplifies this technology. This family, which includes the Talisman S, Talisman B and Talisman A cartridges represents an improved version of the basic technology in that it eliminates intermediate yokes and utilizes only a single magnet with a front pole piece. The front pole piece, which is not a permanent magnet but is magnetically conductive, acts to shape and intensify the magnetic field created by the rear magnet.

Although the prior art cartridges have been capable of extremely good sound reproduction and high quality output, there always remains room for improvement. It is always desirable to create a cartridge with an extremely low stylus tip mass. It is also desirable to construct cartridges which have the fastest possible rise time and capability of responding to the widest possible range of frequencies (widest band width).

It is also desirable to eliminate stray signals and unintentional perturbations of the magnetic field. These can be caused by eddy currents which may occur in pole pieces and yokes. It is also preferrable to eliminate magnetic fringe fields whenever possible.

The technology of pressing records in modern time has achieved such great precision that auditory differences may be heard when cartridges of less than perfect design are utilized, as compared with the ultimate possibilities. Therefore, the industry continues to attempt to achieve phonocartridges having the maximal response characteristics at low weight and at as low of a cost as possible.

DISCLOSURE OF INVENTION

Accordingly, it is an object of the present invention to provide an intensified field focus type of moving coil phonocartridge, thus eliminating eddy currents and fringe effects.

It is another object of the present invention to provide a phonocartridge which generates a high signal strength output which requires less signal amplification than low signal strength outputs version of moving coil cartridges.

A further object of the present invention is to provide an extremely high quality phonocartridge at a reasonable cost.

The present invention is in the nature of a direct field focus moving coil type of phonocartridge assembly which is particularly adapted for use in high precision phonographic record playing. Modern high quality stereophonic equipment is designed such that the turntables have tone arms to which removable cartridges can be attached. The phonocartridges of the present invention are designed to attach to this sort of tone arm.

Briefly, the preferred embodiment of the present invention is an intensified field focus moving coil phonocartridge assembly. The assembly represents an improvement over prior art moving coil types of phonocartridges in that a second cylindrical permanent magnet replaces an array of yokes and pole pieces. The intensified field focus moving coil phonocartridge assembly includes, as its primary operative elements, a stylus for tracking within the record groove, a cantilever for supporting the stylus, a signal coil assembly for conductively receiving the vibrational signal generated in the stylus and cantilever and magnetic field generating magnets which provide a magnetic field chamber in which the signal coil subassembly vibrates and creates electrical signals. The field generating magnets are in the nature of a cylindrical rear magnet and a cylindrical front magnet which between them form a magnetic field chamber within which the signal coil subassembly is located. The front magnet has an aperture formed therethrough such that the cantilever may extend through the magnet to the stylus. The rear magnet and the front magnet are firmly held in position by a support sleeve which is positioned within an exterior frame of the cartridge. The exterior frame, or case, also includes various other physical support and electrical conductive elements which aid the performance of the assembly.

An advantage of the present invention is that the incorporation of a front cylindrical permanent magnet intensifies the field strength within the magnetic field chamber and thus increases the output generated by a given perturbation of the stylus.

Another advantage of the present invention is that various undesirable effects of having pole pieces and yokes present in the magnetic circuit are eliminated.

A further advantage of the present invention is that no external step-up is required.

Yet another advantage of the present invention is that higher output is achieved without increasing the number of windings and thereby adversely affecting the moving mass of the stylus assembly.

A still further advantage of the present invention is that the phonocartridge has excellent tracking ability within the record groove and eliminates audible "straining" in high modulation situations.

Still another advantage of the present invention is that it achieves maximal sound reproduction, in accordance with the high technology of record production, at a reasonable cost.

These and other objects and advantages of the present invention will become clear to those skilled in the art in light of the description of the best presently known mode of carrying out the invention and the industrial applicability of the preferred embodiment as described herein and as illustrated in several figures of the drawing.

BEST MODE OF CARRYING OUT THE INVENTION

Figure 1:
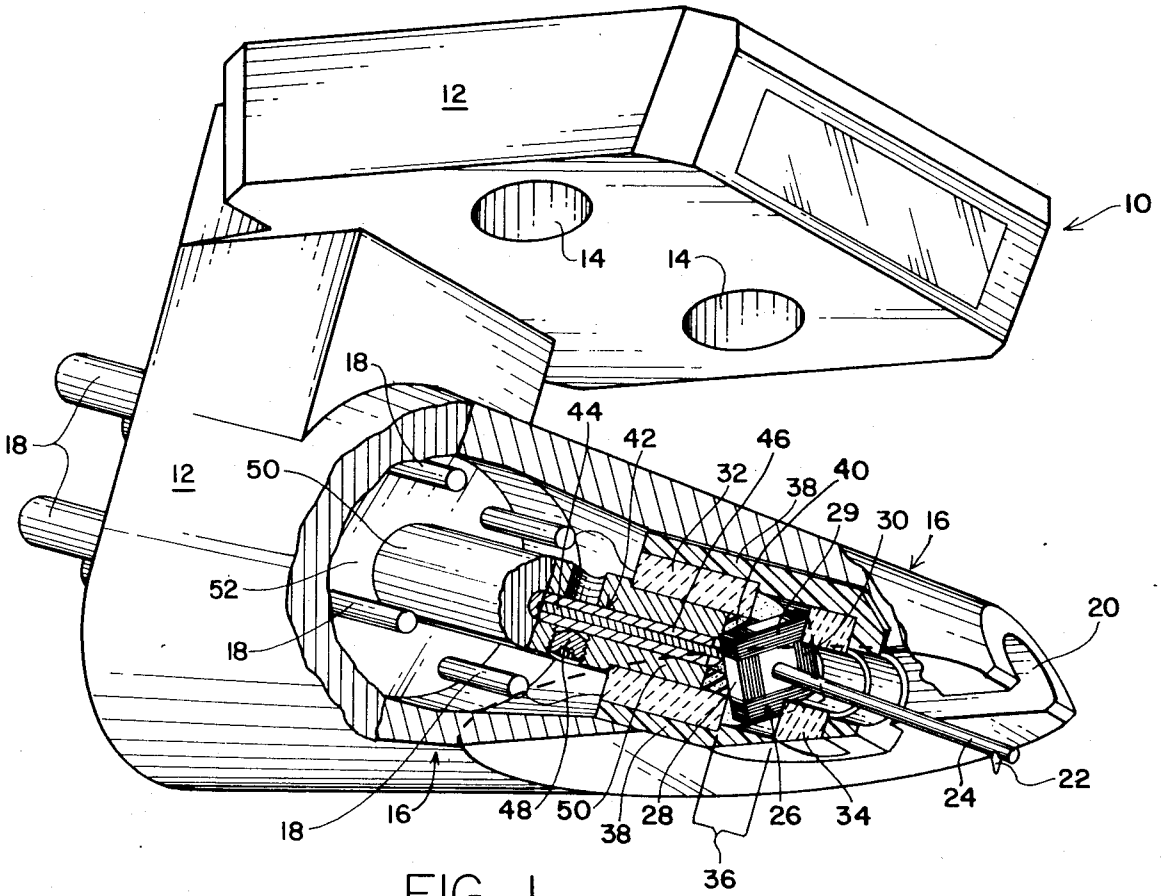
FIG. 1 is a partially cut-away perspective view of an intensified field focus moving coil phonocartridge assembly according to the present invention.

The present invention is an intensified field focus moving coil phonocartridge assembly which is illustrated in a cut-away perspective view in FIG. 1 and designated therein by the general reference character 10. The phonocartridge assembly 10 of the preferred embodiment is adapted for extremely high quality pick up of phonograph record groove surface discontinuity bumps and translation of the physical perturbations them into electrical signals which are then converted into sound waves by stereophonic equipment. The phonocartridge of the present invention are adapted to reach the state of the art in tracking the grooves of a phonograph record and accurately and precisely converting the physical aspects of the groove into precise electrical signals. When utilized with high quality electronic equipment the phonocartridges 10 of the present invention achieve sound reproduction on a par with anything available in the technology.

Figure 2:
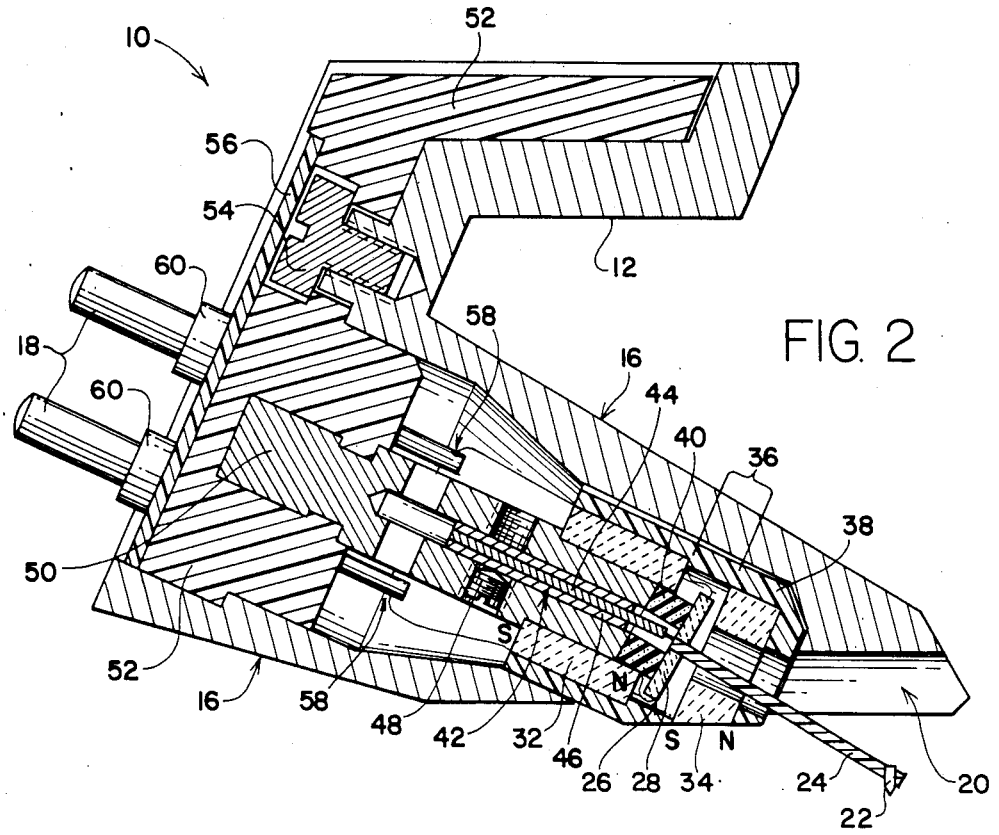
FIG. 2 is a cross-sectional view taken along line 2—2 of FIG. 1.

The phonocartridge assembly 10, illustrated both in FIG. 1 and FIG. 2, includes an exterior frame 12 which is in the nature of a case. The frame 12 is predominantly hollow and is constructed of a high strength, lightweight, non-magnetic and low-resonance material. Zinc is the preferred material.

The upper portion of the frame 12 is the area in which the phonocartridge assembly 10 is attached to the tone arm of a phonograph turntable. The means of attachment is in the nature of attachment fasteners, such as bolts or screws, placed through a pair of attachment fastener apertures 14 formed in the exterior frame 12 and attached to a portion of the tone arm.

The front lower portion of the frame 12 is in the form of a cone 16 which is hollow. A set of four output pins 18 protrude from the rear of the frame 12. These output pins 18 provide an additional interface with the tone arm and deliver the electrical signals from the phonocartridge 10 to the exterior processing elements.

The front portion of the cone 16 includes an axial slot 20 providing access from the exterior to the interior of the cone 16. The cone 16 is truncated at the front and lower surfaces so as to provide for proper spatial positioning and tracking on the phonograph record. Protruding from the slot 20 is a subassembly including the stylus 22 mounted on the end of a cantilever 24. The stylus 22, typically a finely formed diamond, is the portion of the phonocartridge 10 which actually contacts the record groove. The stylus 22 is mounted rigidly within the cylindrical tubular cantilever 24 such that all vibrations caused by tracking of the stylus 22 will be reflected in the cantilever 24. The cantilever 24 is formed of an extremely hard, lightweight material selected for rigidly and true reproduction of vibrations without additive resonances. Preferred materials are sapphire and aluminum-magnesium alloy. Another possible material for the cantilever is boron.

With an aluminum-magnesium alloy cantilever 24 the stylus 22 is elliptically shaped and is a mirror polished square-shank diamond that is nude-mounted to the cantilever 24. The aluminum-magnesium alloy cantilever 24 is notable in that it exhibits exceptional rigidity with low moving mass and extremely low flexion.

When the sapphire cantilever 24 is utilized, the stylus is selected to the brain-oriented and has an extremely long and narrow contact line with a small scanning radius. The sapphire cantilever 24 is a hollow tube which is exceptional in its hardness, its low mass and its mechanical rigidity. The cantilever 24 is laser drilled and then fitted with the stylus 22 to allow the two elements to act as if they have been formed from a single crystal. In this manner, a maximum amount of analogism is achieved between the motion of the stylus 22 within the groove and the resultant vibrational motion of the cantilever 24.

At the end opposite the stylus 22, the cantilever 24 is rigidly attached to a signal coil subassembly 26. The signal coils subassembly 26 includes a lightweight, rigid former member 28. Wound about the former member 28 are a left channel winding 29 and a right channel winding 30. The former member 28 is selected to be extremely lightweight but yet rigid enough to support the windings 29 and 30. The former 28 is not a permanent magnet but may be a magnetic conductor material. In order to avoid flux distortion and to maximize the field strength the former is selected to be magnetically permeable. It is typically ferrite. If one were to use non-insulated windings 29 and 30, then it would be necessary that the former be non-electrically conductive, however, since the windings are insulated this is not necessary. Insulated windings 29 and 30 are necessary to prevent signal interference where the windings overlap.

The left channel winding 29 and the right channel winding 30 are wound transversely to each other on the rectangular solid former member 28. This orientation is selected such that the separate windings lie in perpendicular planes and thus have induced currents caused by magnetic fields in perpendicular vibrational planes. This orientation is necessary for proper channel separation.

The windings 29 and 30 are selected for extreme purity, conductivity and light weight in order to achieve maximum response with minimum moving mass. The preferred winds 29 and 30 are oxygen-free copper wire of extremely thin gauge, having a diameter of $3.77\times10^{-3}$ cm ($15\times10^{-6}$ in.). The ends are laser annealed for flexibility and lack of resonance.

As may be more clearly seen in the cross-sectional view of FIG. 2, the phonocartridge assembly 10 also includes a rear magnet 32 and a front magnet 34 which are both cylindrical in nature and are spatially axially separated to form a field chamber 36 in which the signal coil subassembly 26 is situated.

The positioning of the rear magnet 32 and the front magnet 34 within the cone 16 is provided and maintained by a support sleeve 38. The support sleeve 38 is a plastic element formed about the magnets 32 and 34 and adapted to maintain then in a preselected orientation and separation. The sleeve 38 also mates with the interior of the cone 16 to precisely position the magnets.

The field chamber 36 is in the nature of an open cylindrical volume situated between the rear magnet 32 and the front magnet 34 and enclosed on its circumferential edges by the support sleeve 38. The field chamber 36 provides the volume within which the signal coil subassembly 26 may vibrate in accordance with the vibrational signals delivered through the stylus 22 and the cantilever 24 to the signal coil subassembly 26. Since a strong magnetic field is created within the field chamber 36 by the rear magnet 32 and the front magnet 34, the vibration of the conductive channel windings 29 and 30 within this field results in an induced electrical current within the windings 29 and 30 which is analogous to the vibrations. The former 28 is shaped such that the windings 29 and 30 are normal to one another with each lying 45° from the vertical plane of the stylus 22. This corresponds to the sides of the record groove. Thus, vibrations from one side of the groove (channel) will be in a perpendicular plane from those on the other channel and will generate independent signals in the windings 29 and 30. The windings 29 and 30 are connected to the output pins 18 such that the electrical current generated in the windings 29 and 30 is delivered to the output pins for processing by the external stereophonic equipment. The two ends of the windings 29 and 30 are connected to separate pins such that a signal pin and a ground pin exist for each channel.

Both the rear magnet 32 and the front magnet 34 are cylindrical and have an aperture through the center. The front magnet is also flattened on one exterior edge for mechanical continuity. In the case of the front magnet 34 the aperture provides a passage through which the cantilever 24 extends, as the front magnet in continguous to the slot 20. In the case of the rear magnet 32, the front portion of the aperture provides a zone for receivin an elastic damper 40 which is attached to the rear of the former 28. The elastic damper 40 acts both to absorb residual vibrations and to act as an elastic return to cause the stylus 22 to return to the center of the record groove after being displaced by the physical perturbations. Both of these functions are extremely important in maintaining sound reproduction quality.

The central portion of the remainder of the aperture in the center of the rear magnet 32 is filled by a drag wire subassembly 42. The drag wire subassembly 42 includes a thin drag wire 44, a drag wire sleeve 46 and a drag wire set screw 48. The drag wire sleeve 46 is crimped about the drag wire 44 such that there is no axial motion between the two elements. The drag wire 44 extends through the elastic damper 40 and the signal coil subassembly 26 to attach to the cantilever 24. The drag wire assembly 42 serves the purpose of providing pre-tension to the cantilever 24 and stylus 22 which overcomes the force provided to the stylus 22 by friction as the record moves with respect to the stylus 22. The drag wire 44 provides tension which is against the pull of the groove and thus maintains the stylus 22 in the proper position during use. The drag wire 44, itself, is a very thin wire, typically spring steel, which, for support purposes, is enclosed within the crimped brass or copper tube drag wire sleeve 46.

Surrounding the drag wire subassembly 42, filling the remainder of the interior of the rear magnet and extending cylindrically rearward, is a support post or stanchion 50. This brass member provides structural integrity.

When the stylus and cantilever assemblies are installed in the phonocartridge assembly 10 it is necessary to set the amount of pre-tension provided by the drag wire 44 to a predetermined amount for proper tracking. This is accomplished by providing backward force on the drag wire 44 until the proper tension is achieved and then tightening the drag wire set screw 48 within the support post 40 such that the drag wire set screw 48 engages the drag wire sleeve 46 and holds it firmly in that position.

The support spot or stanchion 50 further serves the purpose of providing back support which connects the rear portion of the frame 12 to the operative elements which exist in the front part of the cone 16. Brass is typicaly selected for the material of the stanchion 50 since it is non-magnetically-conductive and provdies good support characteristics without inducing resonance into the system. The cylindrical stanchion 50 is firmly mounted within a typically plastic holder component 52 which fits snugly into the cavities in the rear portion of the frame 12. The cavity is shaped to prevent motion or rotation of the holder 52. The holder 52 is also affixed to the frame 12 by a main fixing screw 54. A plastic back plate 56 is then provided at the rear of the holder 52 to enclose the rear portion of the phonocartridge assembly 10 and to carry identification information.

In FIG. 2, it may be seen that the left channel winding 29 and the right channel winding 30 are connected to the output pins 18, at positions forward of the holder 52, at a series of winding connection positions 58, one per output pin 18. This illustration also shows that the output pins 18 are rigidly mounted within the holder 52 such that they are held in position. On the exterior of the plastic back plate 56 the output pins 18 are ringed by a series of identifier rings 60, one for each output pin 18. These identifier rings 60 color coded for terminal identification.

Figure 3:
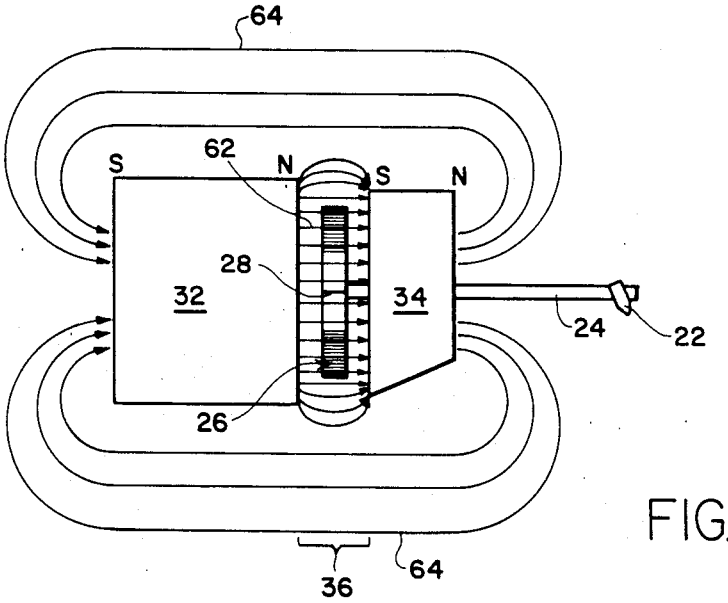
FIG. 3 is a schematic flux diagram of the magnetically operative elements of the present invention.

FIG. 3 illustrates, in schematic fashion, the magnetic flux which is present in the vicinity of the field chamber 36. In this illustration, it may be seen that the rear magnet 32 and the front magnet 34 are oriented such that opposing poles are situated on the opposite sides of the field chamber 36. In the illustration these are shown with the rear magnet having a North pole on its front edge and the front magnet 34 having a South pole on its rear edge. However these designations may be reversed with no net effect, if corresponding output pin 18 labels are changed. The importance is that the poles be opposite such that a strong linear flux is created therebetween.

As may be seen in this illustration, the signal coil subassembly 26 lies within the field chamber 36 in the midst of a field chamber flux 62 which is illustrated in schematic fashion. the drawing also illustrates an exterior flux pattern 64 which provides a return for the magnet energy from the opposite poles of the rear magnet 32 and the front magnet 34. The stronger the field chamber flux 62, the higher the output generated by the left channel winding 29 and the right channel winding 30 for a given perturbation of the stylus 22. Some of the advantages of the present invention derive from the substantial increase in the field chamber flux 62 which is created by the use of a permanent magnet as the front magnet 34 as opposed to merely a pole piece which results in a substantially lower field chamber flux 62.

It is also advantageous to use the strongest magnets feasible, provided they fit the other characteristics of being manufacturable to specific shapes and sizes and being lightweight. The standard material which is being used for the magnets of both the rear magnet 32 and the front magnet 34 has been samarium-cobalt. However, it has been found that neodynium-boron-iron may result in improved performance over samarium-cobalt. It is projected that with the neodynium-boroniron magnetic material it may be possible to dispense with the requirement that the former 28 be magnetically permeable. The increased field strength created by the stronger magnetic material will overcome any distorting effect caused by having a former 28, which is an insulator, within the field chamber flux 62. If this is the case, then a lightweight, rigid former, such as sapphire, may be substituted for the ferrite presently utilized.

The precise shaping of the front and rear magnets is selected for mechanical operation but is not critical to the output of the direct field focus moving coil of the signal coil subassembly 26. In situations where the mechanics are different from those of the preferred embodiment, or where aesthetics are of less concern, other shapes may be utilized. Similarly, other materials may be substituted for those of the preferred embodiment without departing from the spirit and scope of the invention, providing the materials selected have the same essential characteristics.

Those skilled in the art will readily observe that numerous other modifications and alterations of the assembly may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

Since the present invention of an intensified field focus type of moving coil phonocartridge represents significant improvement in the output and quality it is expected that it will have substantial commercial success. Indeed, the "Alchemist" series of phonocartridges of Sumkio, Inc. of Berkeley, Calif., introduced in Mid-1984, incorporates the present invention. These cartridges have achieved wide critical acclaim and are already achieving commercial success.

In this light it is expected that phonocartridge assemblies of the present invention will have extremely widespread industrial applicability and commercial utility within the sound reproduction industry.

What is claimed is:

1. In a moving coil phonocartridge including a magnetic field chamber, a signal coil assembly for vibrating within the field chamber and a cantilever and stylus subassembly for delivering vibrational impulses from the stylus to the signal coil subassembly, the improvement comprising:

a first steady state magnetic means in the form of a first cylindrical permanent magnet having one axial face abutting the rear of the magnetic field chamber, disposed rearward of the field chamber, polarized such that a portion of the magnetic flux generated thereby extends axially across the field chamber from the abutting face of the first magnetic means and further having an aperture formed axially therethrough to permit the cantilever to extend therethrough between the stylus and the signal coil subassembly; and a second steady state magnetic means in the form of a second cylindrical permanent magnet having an axial aperture formed therethrough, said axial aperture receiving an elastic damper attached to the signal coil subassembly and a drag wire subassembly for providing pre-tension to the cantilever and stylus subassembly, disposed opposite the first magnetic means so as to define therebetween the magnetic field chamber, said second magnet having one axial face abutting the front of the magnetic field chamber, the polarity of the second magnetic means being coaxial with that of the first magnetic means and aligned such that the faces of the respective magnetic means abutting the field chamber are opposingly polarized.

2. The improvement of claim 1 wherein:

said first magnet and said second magnet include, as the source of magnetization, a suspension of samarium-cobalt.

3. The improvement of claim 1 wherein:

said first magnet and said second magnet include, as the source of magnetization, a suspension of neodynium-boron-iron.

4. The improvement of claim 1 wherein:

said first magnet and said second magnet are mounted within a nonmagnetic cylindrical sleeve to maintain said magnets in constant spaced-apart juxtaposition, said sleeve further defining the circumferential edges of the magnetic field chamber; and said first magnet and said second magnet include, as the source of magnetization, a suspension of samarium-cobalt.

5. The improvement of claim 1 wherein:

said first magnet and said second magnet are mounted within a nonmagnetic cylindrical sleeve to maintain said magnets in constant spaced-apart juxtaposition, said sleeve further defining the circumferential edges of the magnetic field chamber; and said first magnet and said second magnet include, as the source of magnetization, a suspension of neodynium-boron-iron.

6. In a moving coil phonocartridge including a magnetic field chamber, a signal coil assembly for vibrating within the field chamber and a cantilever and stylus subassembly for delivering vibrational impulses from the stylus to the signal coil subassembly, the improvement comprising:

a first steady state magnetic means in the form of a first cylindrical permanent magnet having one axial face abutting the rear of the magnetic field chamber, disposed rearward of the field chamber, polarized such that a portion of the magnetic flux generated thereby extends axially across the field chamber from the abutting face of the first magnetic means; and a second steady state magnetic means in the form of a second cylindrical permanent magnet having a axial aperture formed therethrough, said axial aperture receiving an elastic damper attached to the signal coil subassembly and a drag wire subassembly for providing pre-tension to the cantilever and stylus subassembly, disposed opposite the first magnetic means so as to define therebetween the magnetic field chamber, said second magnet having one axial face abutting the front of the magnetic field chamber, the polarity of the second magnetic means being coaxial with that of the first magnetic means and aligned such that the faces of the respective magnetic means abutting the field chamber are opposingly polarized; and said first magnet and said second magnet are mounted within a nonmagnetic cylindrical sleeve to maintain said magnets in constant spaced-apart juxtaposition, said sleeve further defining the circumferential edges of the magnetic field chamber.

7. The improvement of claim 6 wherein:

said nonmagnetic sleeve is also magnetically nonconductive.

* * * * *